United States Patent [19]

Wright et al.

[11] Patent Number: 4,875,412

[45] **Date of Patent:' * Oct. 24, 1989**

[54] PRINTING PRESS BLANKET CLEANER

[76] Inventors: Norman D. Wright, 101 Cardinal Dr., Belleville, Ill. 62221; Gary C. Glanzner, 5083 Towne Center Dr., St. Louis, Mo. 63128; John A. Signorelli, 12334 E. Inlet Ridge, Maryland Heights, Mo. 63043

[ * ] Notice: The portion of the term of this patent subsequent to May 26, 2004 has been disclaimed.

[21] Appl. No.: 197,036

[22] Filed: May 20, 1988

[51] Int. Cl.[4] ..... B41L 41/00; A47L 13/52

[52] U.S. Cl. ..... 101/425; 101/167; 101/423; 15/105; 15/257.2

[58] Field of Search ..... 101/155, 156, 157, 167, 101/168, 169, 423, 424, 425; 15/256.5, 257.2, 105

[56] References Cited

U.S. PATENT DOCUMENTS

| | | | |
|---|---|---|---|
| 504,465 | 9/1893 | Beater | 101/167 |
| 1,114,893 | 10/1914 | Lerche | 101/425 |
| 2,844,123 | 7/1958 | Hayford | 101/425 X |
| 3,049,947 | 8/1962 | Grembecki et al. | 101/425 |
| 4,537,130 | 8/1985 | Theilacker | 101/425 |
| 4,667,597 | 5/1987 | Wright et al. | 101/425 |
| 4,704,963 | 11/1987 | Nishimura et al. | 101/423 X |
| 4,757,763 | 7/1988 | MacPhee et al. | 101/425 |

*Primary Examiner*—Edgar S. Burr
*Assistant Examiner*—James R. McDaniel
*Attorney, Agent, or Firm*—Polster, Polster and Lucchesi

[57] ABSTRACT

A blanket cleaner for removing dust, lint or ink from a blanket cylinder in an offset printing press during the uninterrupted course of a press run. A first fluid cylinder periodically urges a brush against the blanket cylinder and retracts the brush from the blanket cylinder. Retraction of the brush permits the dust and lint swept before the brush to fall onto a door of a lint catcher. The door is raised and lowered by action of a second fluid cylinder. Operation of the second fluid cylinder lags the operation of the first fluid cylinder by an interval of time sufficient to permit the dust, lint or ink to fall onto the door. In the preferred embodiment, the structure includes a device for removal of debris from the lint catcher.

10 Claims, 2 Drawing Sheets

PRINTING PRESS BLANKET CLEANER

BACKGROUND OF THE INVENTION

The portion of the term of this patent following May 26, 2004, the date of expiration of our U.S. Pat. No. 4,667,597, is disclaimed.

This invention relates to printing presses, and in particular, to an apparatus for cleaning a blanket cylinder in an offset printing press without either interrupting the operation of the press or slowing down its operation.

An offset printing press employs a blanket cylinder, that is to say, a rubber cylinder or a rubber-covered cylinder, for the purposes of receiving inked images from a printing plate and of next offsetting the inked images onto paper passed between the blanket cylinders or an impression cylinder Continuous printing is made possible by wrapping a printing plate or a plurality of printing plates around the surface of a plate cylinder designed for rotation in contact with the blanket cylinder. In operating blanket-to-blanket presses, a web of paper passes between two blanket cylinders mounted such that one blanket cylinder serves as an impression cylinder for the other, resulting in simultaneous printing on both sides of the web of paper. Offset printing, in comparison with the letterpress method of printing, has become the predominant printing method in the newspaper publishing industry due in part to the increased sharpness of the printed images and the ability to print on less even surfaces than are required by the letterpress method, and the lower cost of the printing plates used with offset presses.

However, in continuous offset printing, dust and lint from the web of paper tend to accumulate on the blanket cylinder(s), adversely affecting the quality of the printed product. The accumulation of dust, lint or ink on a blanket cylinder thus presents a serious annoyance and necessitates undesirable down-time for cleaning. The problem is especially acute in the newspaper industry, when, in response to the rising cost of newsprint stock, less expensive grades of paper having higher lint content often are substituted for more expensive grades.

The invention disclosed hereinafter provides an apparatus for cleaning a blanket cylinder during the course of a press run, without interrupting press operation or causing waste during the run. Consequently, a sharper reproduction for a printed product is possible, less down-time is experienced, and grades of paper stock having higher lint contents may be used. The frequency of the automatic engagement and operation of the blanket cleaner of this invention is adjustable by a press operator in response to various anticipated or observed operating parameters such as the length of the press run and the lint content of the paper stock.

The apparatus is suitable for integral construction with an offset press, or for manufacture as an add-on device for retrofitting to an existing press.

One of the objects of this invention is to provide an apparatus for removing dust and lint from a blanket cylinder during the uninterrupted course of a press run.

Another object of this invention is to provide an economical blanket cleaner of simple mechanical action, suitable for retrofitting to existing offset presses.

Another object of this invention is to provide a blanket cleaner adapted for automatic operation at a frequency of engagement adjustable by a press operator.

Another object of this invention is to provide an effective blanket cleaner which will not abrade the blanket cylinder.

Another object of this invention is to provide a blanket cleaner which promote longer blanket life.

Yet another object of this invention is to provide a blanket cleaner which may be operated without causing waste of materials.

Still another object of this invention is to provide a blanket cleaner which operates to provide a longer plate life.

Other objects of this invention will be apparent to those skilled in the art in light of the following description and accompanying drawings.

SUMMARY OF THE INVENTION

In accordance with this invention, generally stated, an apparatus for cleaning a blanket cylinder of an offset printing press during operation of the press is provided, having a brush which periodically is urged against the blanket cylinder, and a lint catcher. The brush is retractably urged against the blanket cylinder by the motion of a pivoting arm and a brush holder, connecting the brush with a first fluid cylinder. Action of the brush in combination with rotation of the blanket cylinder is such as to sweep dust and lint before the brush on the blanket cylinder. The lint catcher is positioned to receive the dust and lint upon retraction of the brush from the blanket cylinder In one embodiment of the blanket cleaner the lint catcher includes a door which is opened and closed by the action of a second fluid cylinder. In an open position, the door is situated below the brush and adjacent to the blanket cylinder; consequently, upon retraction of the brush, dust and lint are deposited on the door. Closing the door further increases the elevation of an angle between the plane of the door and the horizontal such that the dust and lint which have been deposited on the door move into the lint catcher. Timing mechanisms related to rotation of the press regulate the operation of the first and second fluid cylinders. The operation of the second fluid cylinder is delayed with respect to operation of the first fluid cylinder in order to provide sufficient time for the dust and lint to be deposited on door after the brush has been retracted. Preferably, means are provided for removing the dust and lint from the lint catcher.

DESCRIPTION OF THE PREFERRED EMBODIMENT

Figure 1:
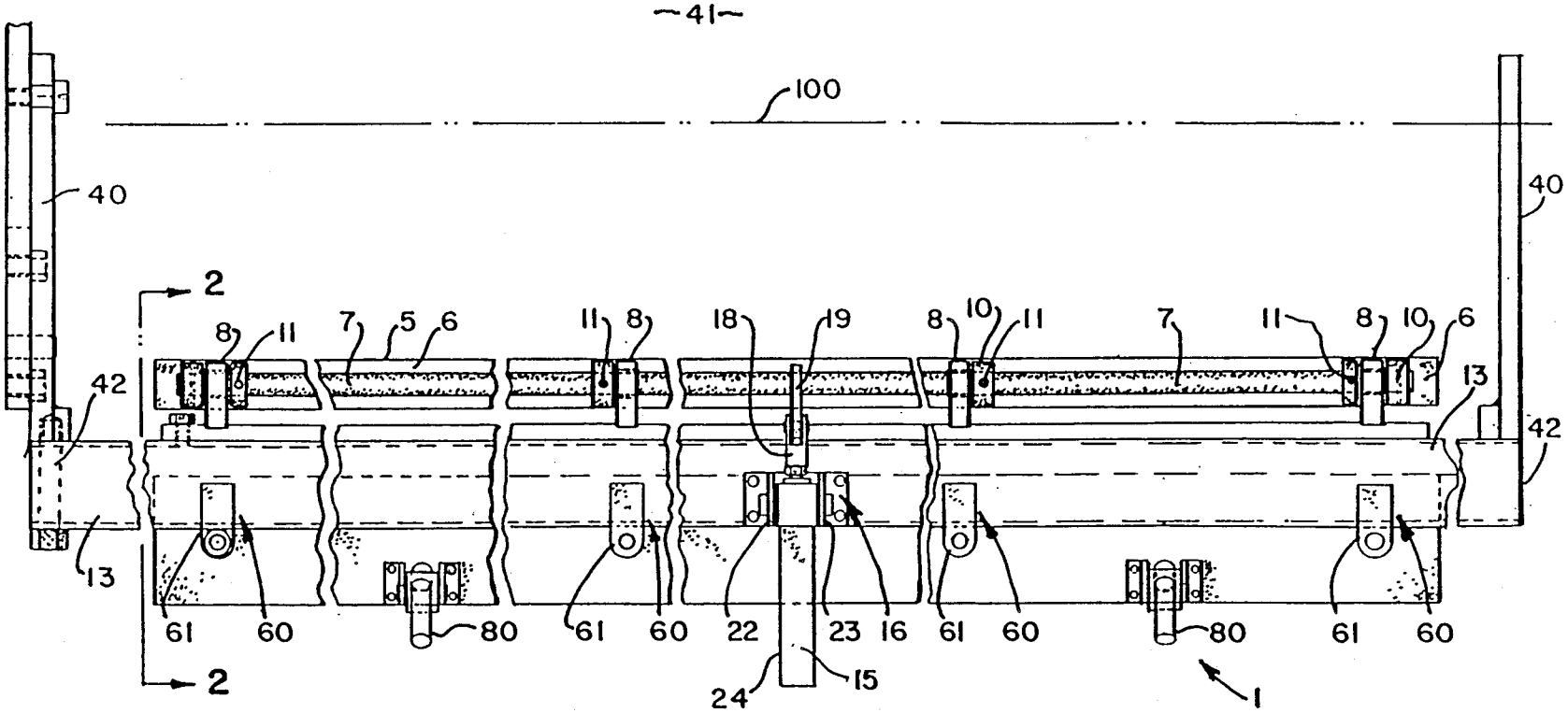
FIG. 1 is a top plan view of one embodiment of blanket cleaner which is the subject of this invention.

Referring now to the drawings, reference numeral 1 indicates one illustrative embodiment of blanket cleaner of this invention. In general, the blanket cleaner 1 includes a brush assembly 2 and a lint catcher 3, best seen in FIG. 2.

Structural support for the blanket cleaner 1 of this invention is provided by a support beam 13 which is mounted parallel to a longitudinal axis 100 of a blanket cylinder 41. The support beam 13 extends beyond the length dimension of the blanket cylinder 41, and is attached to the press frame by any suitable means. In the embodiment shown in FIG. 1, each of the beam ends 42 of the support beam 13 are attached to a portion of a press frame 40 by conventional threaded fasteners Those skilled in the art will appreciate that the mounting arrangement can vary, depending upon the type of press upon which the blanket cleaner 1 is employed.

The brush assembly 2 and lint catcher 3 are supported from the beam 13 as later described in greater detail.

A brush device 5 is mounted to a brush holder 6 which in turn is mounted to a rod 7. The rod 7 is journaled for rotation along a plurality of supports 8. The supports 8 in turn are mounted to the support beam 13 by any convenient method. Welding works well, for example. In any event, the supports 8 support the rod 7 and permit its rotation between at least a first position where the brush device 5 is disengaged from the blanket cylinder 41 and a second position where the brush device 5 is in engagement with the blanket cylinder 41. The brush holder 6 includes a replaceable element 9 which is removably mounted to the brush holder 6 and permits replacement of a pair of brushes 4, as required. We have found that brush pair 4 has relatively long life. However, continual operation will require replacement of the brush pair. A variety of devices can be used for the brushes 4, provided that they do not damage the cover of the blanket cylinder 41. We have found that a brush pair operates effectively in the operation of our invention. However, a single brush may be used, and the brush pair 4 is referenced to hereinafter merely as "brush 4".

The supports 8 include a plurality of collars 10 which include set screws 11 which are utilized to position the rod 7 longitudinally with respect to the blanket cylinder 41. Other means for maintaining position of the rod 7 with respect to the cylinder are compatible with the broader aspects of this invention.

A fluid actuator 15 is mounted to the support beam 13 along a mount 16. The actuator 15, in the embodiment illustrated, is an air cylinder, and is operatively connected to a source of fluid pressure, not shown. The piston of the actuator 15 has a shaft 17 extending from it. A clevis 18 is attached to the shaft 17 in any convenient way. Again, a threaded interconnection works well. The clevis 18 has an arm 19 fitted to it. The arm 19 is interconnected to the clevis 18 by a pin 20. The arm 19 in turn is attached to the rod 7. As later described, movement of the piston of the actuator 15 causes linear movement of the shaft 17, that linear movement being translated to rotational movement of the brush assembly 2 by the connection of the arm 19 and rod 7.

The mount 16 is conventional, and includes first and second shoulders 22 and 23, respectively, which receive a mounting block portion 24 of the actuator 15.

Figure 2:
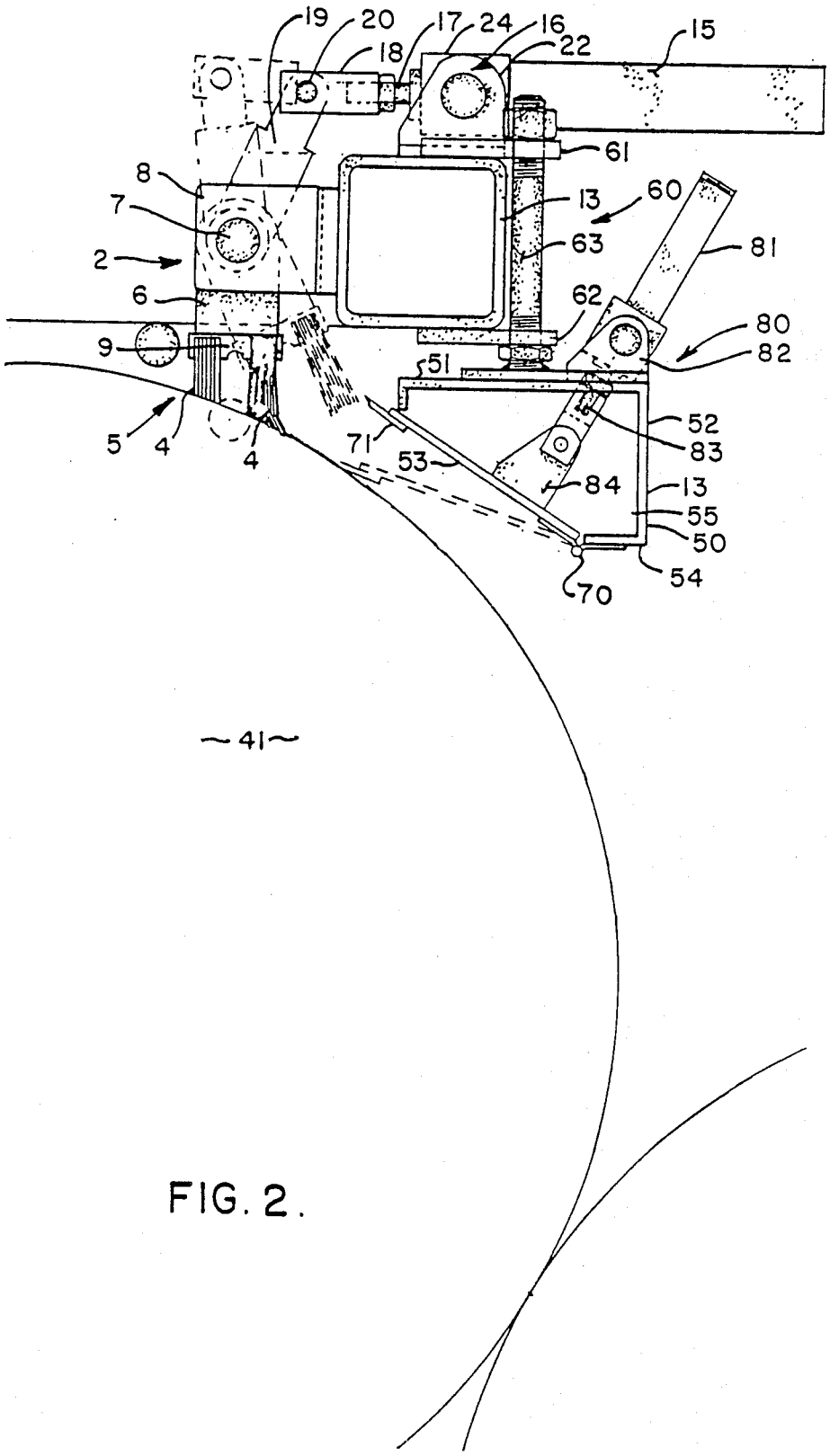
FIG. 2 is a side view of the blanket cleaner of FIG. 1, taken along line 2—2 of FIG. 1.

The lint catcher assembly 3 includes a housing 50, which may assume a variety of different designs. In the embodiment illustrated in FIG. 2, the housing 50 includes a top wall 51, a back wall 52, a front or door 53, a bottom 54, and a pair of end walls 55, only one of which is shown in FIG. 2. The housing 50 has a longitudinal length slightly greater than the length of the brush assembly 2, for purposes later described in greater detail.

The housing 50 is attached to the support beam 13. That attachment may be accomplished in a number of ways. We find it convenient to use a plurality of mounting structures 60. The number of mounting structures 60 employed depends upon the longitudinal length of the lint catcher assembly 3. In the embodiment illustrated, four of the mounting structures 60 are used. Each of the mounting structures 60 includes a top arm 61 and a bottom arm 62 attached to the support beam 13. Each of the arms 61 and 62 has an opening in it, sized to receive a member 63. The member 63 has too threaded portions, one each positioned along the respective ends of the member 63. Alternatively, the entire member 63 may be threaded. The openings in the arms 61 and 62 receive the member 63, and the threaded portions of the member 63 enables one to adjust the axial height, referenced to FIG. 2, of the housing 50 with respect to the blanket cylinder 41. The member 63 is attached to the top 51 of the housing 50, either directly or through a suitable support.

The front or door 53 of the housing 50 is hingedly attached to the bottom 54 along a hinge 70. The hinge 70 is conventional and any one of a number of well known hinges is compatible with my invention. The hinge 70 may extend the entire length of the housing 50 or a plurality of individual hinges spaced from one another may be employed, if desired. The front 53 preferably has a resilient lip 71 mounted to it. The lip 71 may be made replaceable if desired. In any event, the resilient lip 71 acts to prevent damage to the blanket cylinder 41 during operation of the lint catcher assembly 3.

At least one door 53 operating mechanism 80 is mounted to the housing 50. In application use, the number and location of the operating mechanisms 80 are determined by the longitudinal length of the blanket cylinder 41. In the embodiment illustrated, two of the operating mechanisms 80 are utilized in conjunction with the lint catcher assembly 3. The operating mechanism 80 includes a fluid actuator 81 attached to the enclosure 50 along a mount 82. The actuator 81 includes a shaft 83 linked to an arm 84. The arm 84 in turn is attached to the door 53. Operation of the actuator 81 causes the door 53 to rotate along the hinge 70 between at least a first position, shown in full lines in FIG. 2, and a second position, shown in dashed lines in FIG. 2. In both the first and second positions of the front 53, the angle made between the front and the bottom wall 54 is such as to permit dust and lint particles to move under the influence of gravity downwardly and rearwardly toward the back 52 of the housing 50. As indicated above, the vertical position of the housing 50 can be adjusted, as can the stroke of the actuator 81, so that operation of the lint catcher can be controlled precisely with respect to a particular press installation.

Preferably, the actuators employed are pneumatic actuators, although electrical or hydraulic actuators can be used if desired. Conventionally, compressed air commonly is available in press rooms, while electrical or fluid sources are not. Operation of the blanket cleaner of this invention may be controlled by conventional timing mechanisms related either to rotation of the presses or on command of the operator. In any case, the operation of the various actuators are controlled so that when blanket cleaning is desired, the actuators 81 are operated so that the front 53 moves to the phantom line position shown in FIG. 2. Thereafter, the actuator 15 is moved from the phantom line position shown in FIG. 2, to the full line position here illustrated, to bring the brush 4 of the brush device 5 into contact with the blanket cylinder 41. The brush 4 is utilized to wipe the blanket cylinder 41, and after a predetermined number of rotations has occurred, the actuator 15 is operated to cause the brush device 5 to assume the phantom line position in FIG. 2. Since the front 53 is in its phantom line position, any materials that have been caught on the brush 4 are permitted to enter the enclosure 50 of the lint catcher 3, after which the actuator 81 is operated to cause the front 53 to move to the solid line position of the front 53. Lint thereafter is caused to fall, either under the influence of gravity or through a pressure source, toward the bottom 54. Those skilled in the art will recognize that additional fluid or vacuum devices may be employed to provide for automatic removal of lint and debris from the enclosure 50.

The particular embodiment just described is preferred because of the ease of installation and adjustment provided the construction described. For example, the various working parts are located physically above and in front of the blanket cylinder 41, and thus are readily accessible both for installation and maintenance. Other locations are compatible with the broader aspects of our invention. However, we perceive that merely utilizing the brush assembly may be employed in certain embodiments of the invention, in that an under arch embodiment of the brush obviates the need for the lint catcher assembly. That is to say, debris and lint swept before the brush 5 in such an embodiment simply would fall under the influence of gravity to some other form of lint catcher. For example, the catcher can be a hinged plate. While the catcher is simplified, the embodiment described is preferred because of the ease of installation in comparison to an under arch embodiment.

Numerous variations, within the scope of the appended claims, will be apparent to those skilled in the art in light of the foregoing description and accompanying drawings. As indicated, other fluid operating sources or other timing mechanisms may be employed to alter the operation of the actuators disclosed. The sequence of the operating mechanism may be changed, if desired. The shape or form of the enclosure 50 of the dust catcher may be varied. A vacuum system similar to that employed in conventional Xerographic equipment can be utilized in conjunction with the operation of the brush device 5, in place of the lint catcher assembly 3 or in addition to it. Some form of electric static collector also can be employed, if desired. These variations are merely illustrative.

Having thus described the invention, what is claimed and desired to be secured by Letters patent is:

1. In an offset printing press having a blanket cylinder adapted to rotate about a longitudinal axis, the improvement which comprises a dry mechanical blanket cleaner system for removing dust and lint from said blanket cylinder during an uninterrupted course of a press run, said blanket cleaner system including a normally non-rotating brush means operatively mounted to said press, said brush means including at least one brush mounted for movement between at least a first position where said brush is in contact with said blanket cylinder and second position where said brush is remote from said blanket cylinder, means for moving said brush between said first and said second positions; means for mounting said brush to said press including means for adjusting the position of said brush with respect to said blanket cylinder; and means for receiving and automatically removing debris from said brush when said brush is moved to said second position, said last mentioned means including vacuum means for receiving debris from said brush.

2. The improvement as defined in claim 1 wherein said receiving means also includes an enclosure, and said vacuum means being operatively associated within said enclosure for automatically removing debris from said brush.

3. The improvement as defined in claim 2 wherein said enclosure is operatively positioned relative to said blanket cylinder to facilitate the collection of debris from said brush.

4. The improvement as defined in claim 3 wherein said at least one brush is operatively mounted within said enclosure.

5. The improvement as defined in claim 4 wherein said enclosure includes at least one resilient lip for engaging the blanket cylinder.

6. In an offset printing press having a blanket cylinder adapted to rotate about a longitudinal axis, the improvement which comprises a dry mechanical blanket cleaner system for removing dust and lint from the blanket cylinder during an uninterrupted course of a press run, said blanket cleaner system including brush means operatively mounted to said press, said brush means including at least one brush mounted for movement between at least a first position where said brush is in contact with said blanket cylinder and a second position where said brush is remote from said blanket cylinder, means for moving said brush between said first and said second positions; and fluid means for automatically removing debris from said brush.

7. The improvement as defined in claim 6 including an enclosure operably associated relative to said fluid means for receiving and automatically removing debris from said brush.

8. The improvement as defined in claim 7 wherein said enclosure is operatively positioned relative to said blanket cylinder to facilitate the collection of debris from said brush.

9. The improvement as defined in claim 8 wherein said at least one brush is operatively mounted within said enclosure.

10. The improvement as defined in claim 9 wherein said enclosure includes at least one resilient lip for engaging the blanket cylinder.

* * * * *

UNITED STATES PATENT AND TRADEMARK OFFICE

CERTIFICATE OF CORRECTION

PATENT NO. : 4,875,412

DATED : October 24, 1989

INVENTOR(S) : Norman D. Wright, et al

It is certified that error appears in the above-identified patent and that said Letters Patent is hereby corrected as shown below:

Column 1, line 19 is "cylinder Continuous" should be --cylinder. Continuous --;

Column 2, line 29 is "cylinder In" should be --cylinder. In--;

Signed and Sealed this

Fourth Day of December, 1990

*Attest:*

HARRY F. MANBECK, JR.

*Attesting Officer*

*Commissioner of Patents and Trademarks*